United States Patent [19]

Penelon

[11] Patent Number: 4,825,119

[45] Date of Patent: Apr. 25, 1989

[54] LOW CONSUMPTION ELECTRON GUN FOR CATHODE RAY TUBES

[75] Inventor: Maryvonne Penelon, Lyons, France

[73] Assignee: Videocolor, Montrouge, France

[21] Appl. No.: 941,748

[22] Filed: Dec. 15, 1986

[30] Foreign Application Priority Data

Dec. 17, 1985 [FR] France ..... 85 18696

[51] Int. Cl.[4] ..... H01J 1/16; H01J 19/10

[52] U.S. Cl. ..... 313/344

[58] Field of Search ..... 313/344

[56] References Cited

U.S. PATENT DOCUMENTS 2,359,302 10/1944 Curtis ..... 313/344
3,280,452 10/1966 Merritt .
4,151,441 4/1979 Puhak ..... 313/446

FOREIGN PATENT DOCUMENTS 801709 8/1936 France .

OTHER PUBLICATIONS

Patents Abstracts of Japan, vol. 3, No. 92 (E-128), Aug. 4, 1979, p. 48 E 128; & JP-A-54 69 952 (Tokyo Shibaura Denki K.K.) 06-05-1979.

Patents Abstracts of Japan, vol. 1, No. 8, Mar. 16, 1977, p. 198 E 76; & JP A 51 113 451 (Tokyo Shibaura Denki K.K.) 10-06-1976.

*Primary Examiner*—Theodore M. Blum
*Attorney, Agent, or Firm*—Oblon, Fisher, Spivak, McClelland & Maier

[57] ABSTRACT

A low consumption electron gun is provided for cathode ray tubes. The heating filament of the cathode includes a resistant wire and lugs for connection to an electric energy supply. The resistant wire is wound spirally. The active part of the heating filament is formed of at most two turns, each of which is formed by a multiplicity of elementary turns; the connecting lugs have a core made from a low electric resistance metal which short circuits the elementary turns of the resistant wire.

8 Claims, 1 Drawing Sheet

LOW CONSUMPTION ELECTRON GUN FOR CATHODE RAY TUBES

BACKGROUND OF THE INVENTION

The invention relates to an electron gun for cathode ray tubes, more especially for a color television tube.

A television receiver is a domestic appliance for which it is preferable that the electric energy consumption be small. In such an appliance a part of the energy is consumed by the electron guns of the cathode ray tube, more particularly by the heating filaments of the cathodes.

Furthermore, since television tubes are mass produced, such reduction in consumption must not be obtained at the cost of an increase in the manufacturing complexity.

The reduction of energy consumption must not cause disadvantages in operation either, such as an increase in the time of heating the cathodes or a reduction of the temperature thereof.

The invention provides an electron gun with low electric energy consumption, which is simple to construct and has a short heating time for the cathodes.

SUMMARY OF THE INVENTION

It is characterized in that the heating filament of the cathode of electron gun includes a resistant wire shaped in a spiral with a multitude of elementary turns, and having two connection lugs each of which has a core which short circuits the elementary turns in these lugs as well as an active part formed by one or at most two, spiralled wire turns. To avoid any confusion it should be mentioned here that each turn, limited in number, of the active part is formed of a large number of elementary turns.

With the lugs short circuited, the electric energy is only consumed by the spiralled wire turns which are in the vicinity of the surface to be heated. Since, moreover, the number of turns is reduced to two at most, the distance of the active part of the heating filament from the emissive surface of the cathode is reduced to a minimum, which reduces the heat losses; the spiral arrangement of the wire provides a great heating resistance in a small volume and also results in a reduction of the losses It has further been discovered that the electric energy consumption increases surprisingly with a filament thus formed and, moreover, without providing heat insulation of the cathode to be heated. Thus, in one embodiment, the electron gun is fixed to two tongues—forming the longitudinal framework of the electrode gun assembly of the tube—through metal lugs, so non-thermally insulating.

Another advantage of the invention is that the lugs of the heating filament are rigid, that they may be readily soldered and that their electric resistance is independent of their length.

The resistant wire is for example made from tungsten and the core from molybdenum.

For manufacturing the heating filament of the cathode, the procedure is for example as follows: first of all the resistant wire is wound on a metal wire or core of low electric resistance, then this spiralled wire wound on its core is shaped so as to form two current intake lugs and one or two turns of spiralled wire, then all the elementary turns of the spiralled wire which are in the active part are insulated and finally the core present in the active part is dissolved by selective chemical etching.

BRIEF DESCRIPTION OF THE DRAWINGS

Other features and advantages of the invention will be clear from the following description of some of its embodiments, with reference to the accompanying drawings in which.

DESCRIPTION OF THE PREFERRED EMBODIMENT

Figure 1:
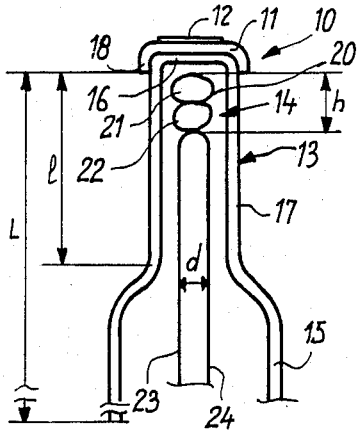
FIG. 1 is a diagram of a cathode and of the filament of an electron gun of the invention.

The example which will be described with reference to the figures relates to a color television tube of the type having a mask perforated with in line electron guns, i.e. whose axes are coplanar. However, for the sake of simplicity, only a single cathode of the electron gun has been shown.

The cathode of an electron gun has an emissive surface 10 (FIG. 1) formed by a nickel based metal support 11 containing about 4% of tungsten as well as dopants such as magnesium and silicon. On this support 11 is disposed a coating 12 of barium carbonate, strontium and calcium.

The emissive surface 10 forms the bottom of a cylindrical sleeve 13 inside which is located a tungsten heating filament 14.

Sleeve 13 is made from a nickel and chromium alloy with low thermal expansion. The inlet part 15, opposite the bottom 16 comprising the cathode properly speaking, has a larger diameter than the end portion 17.

In a way known per se, for manufacturing the sleeve 13, a metal foil is used having two thicknesses, one made from a nickel-chromium alloy and the other from nickel; when this foil has been shaped as shown in FIG. 1, that is to say in the shape of a sleeve closed at bottom 16 with an inlet part of larger diameter, the thickness of nickel which is on the outside is removed, for example, by chemical etching, except at the end forming the end gap 11 which however keeps a flange 18. The advantage of removing the nickel layer from the cylindrical surface is that the thickness is thus reduced and the mass of metal to be heated is therefore correspondingly reduced.

Figure 2:
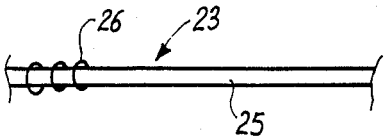
FIG. 2 is a diagram showing a connection lug portion of the filament of FIG. 1.

The heating filament 14 is formed of an active part 20 with two turns 21 and 22 and two lugs 23 and 24 bringing the electric current. It is formed from a molybdenum core which is formed of a wire 25 having a diameter of 115μ (FIG. 2) on which is wound a finer tungsten wire 26 of a diameter of 30μ.

In the lugs 23 and 24 the molybdenum core 25 is kept so as to short circuit the tungsten turns 26. Thus the electric resistance of these lugs 23 and 24 is negligible and the Joule effect losses in these lugs are also negligible.

Figure 3:
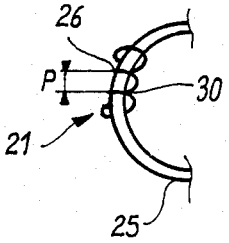
FIG. 3 is an enlarged diagram of a part of the spire of the heating filament of FIG. 1.
Figure 4:
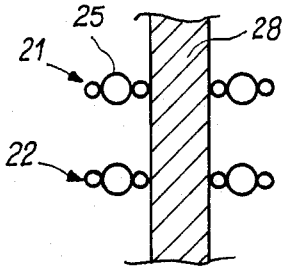
FIG. 4 shows a step in the manufacture of the filament.

To form the turns 21 and 22 of the active part 20 of the heating filament 14, spiralling or winding needle mandrel 28 (FIG. 4) is usually used. Thus, in FIG. 4, the two turns 21 and 22 have been shown during forming on needle 28. In FIG. 3, a part of turn 21 has been shown during forming with core 25 and wire 26.

After formation of turns 21 and 22, the elementary turns 30 of the tungsten wire 26 are coated with an insulating agent then in these turns 21 and 22 of core 25 is caused to disappear, for example by chemical etching.

In the example, each turn 21, 22 has a diameter of 1 mm and the height h of the active part 14 of the heating filament, i.e. the height over which the two turns 21 and 22 extend, is 1.2 mm. The total number of elementary turns of wire 26 on turns 21 and 22 is 233. The distance d separating lugs 23 and 24 is 1 mm.

Thus each turn 21 or 22 contains a hundred or so primary turns. The pitch p between two primary turns is 0.56 mm.

The inner diameter of the front portion 17 of the cathode sleeve is 1.3 mm. The length 1 of portion 17 is 5.5 mm and the length L of the whole of the sleeve is 8.76 mm.

With such a construction, it has been discovered that an electric current of an intensity of 320 milliamperes is sufficient in each filament for obtaining correct operation of a color television tube, with a brilliance temperature of 1050° K. for the cathode.

Figure 5:
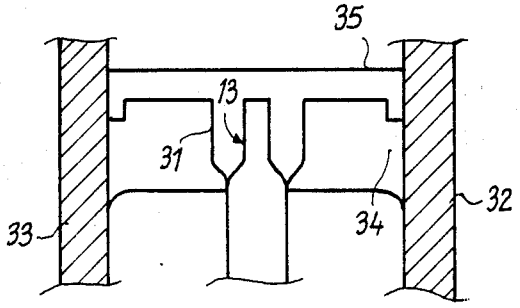
FIG. 5 is a reduced scale diagram of an electron gun portion for a color television tube.

The low electric energy consumption thus obtained forms a result all the more surprising that no particular precaution has been taken for thermally isolating the cathode 13 from the other parts of the electron gun. Thus, in the example shown in FIG. 5, cathode 13 is disposed in a metal housing 31 which is connected to two longitudinal frames 32 and 33 through metal lugs 34. The two frames 32 and 33 also support the other electrodes of the electron gun (only the wehnelt 35 has been shown in FIG. 5). With other prior constructions low consumption was also obtained but by complicating the manufacture by a good thermal insulation of the cathode; in particular, in these prior constructions, the lugs for connecting to the frames are made from an insulating material, more especially from a ceramic material.

Furthermore, it has been discovered that despite the small pitch p between two elementary turns 30, which pitch is of the order of 3% of the diameter of turn 21 or 22, it was possible, using conventional manufacturing techniques (those described with reference to FIG. 4 more particularly) to prevent these elementary turns 30 from coming into contact with each other, which contact would result in reducing the electric resistance of the heating filament.

The small area of the active surface 12 of the cathode, the low electric resistance of lugs 23 and 24 and the concentration of electric energy as close as possible to surface 12 contribute to the low electric energy consumption. Furthermore, with the filament formed as described above, the lugs 23 and 24 may be readily welded for their electric supply connection. Finally, the core 25 of lugs 23 and 24 makes these latter rigid. Thus the lugs are welded directly to connecting bars and, because of the rigidity, the lugs are readily mounted parallel to each other.

What is claimed is:

1. An electron gun for a cathode ray tube wherein said electron gun is more particularly used for a color television tube of the type with perforated mask with three in line guns, having a cathode with an emissive surface at the end of a cylindrical sleeve in which is located a heating element including a resistance wire and connecting lugs for connection to an electric energy supply, wherein the heating element includes a filament which is formed of spirally wound resistance wire having elementary turns wherein said filament includes an active part being formed of at most two turns; and said connecting lugs having a core made from a low electric resistance metal which short circuits said elementary turns of said resistance wire and wherein the extent of said active part of said filament in a direction perpendicular to said emissive surface is approximately the same as the extent of said active part of said filament in a direction parallel to said emissive surface.

2. The electron gun as claimed in claim 1, wherein the resistance wire is made from tungsten.

3. The electron gun as claimed in claim 1 or 2, wherein the core of the lugs is made from molybdenum.

4. The electron gun as claimed in claim 1, wherein each of the turns of the heating filament contains about a hundred elementary turns of resistance wire.

5. The electron gun as claimed in claim 1, wherein the pitch between two elementary turns of resistance wire is on each turn of the active part of the heating filament, of the order of 3% of the diameter of said turn.

6. The electron gun as claimed in claim 1, wherein the cathode sleeve is connected to longitudinal frames of the gun through metal lugs, without heat insulation.

7. The electron gun as claimed in claim 1 wherein said spirally wound resistance wire of said active part of said filament is coated with an insulating agent.

8. A method for manufacturing a heating element for an electron gun wherein said electron gun is more particularly used for a color television tube and is of the type with a perforated mask with 3 in line guns, and having a cathode with an emissive surface at the end of a cylindrical sleeve in which a heating element is located wherein said heating element includes a resistive wire and lugs for a connection to an electrical energy supply with the heating filament being formed of spirally wound resistance wire, its active part being formed of at most two turns and a connecting lugs having a core made from a low electric resistance metal which short circuits the elementary turns of the resistant wire, comprising the steps of:

providing a core of metal wire;

winding a resistance wire of diameter smaller than the diameter of said metal wire on said core and subsequently forming said lugs and turns wherein the elementary turns on each active turn are insulated and the core only in said turns is dissolved.

* * * * *